United States Patent [19]

DiMarzio et al.

[11] Patent Number: 4,861,325

[45] Date of Patent: Aug. 29, 1989

[54] CARTON FORMER

[75] Inventors: Frank DiMarzio, Glenmore; David Mitman, Atglen, both of Pa.

[73] Assignee: Dopaco, Inc., Downingtown, Pa.

[21] Appl. No.: 93,995

[22] Filed: Sep. 4, 1987

Related U.S. Application Data

[63] Continuation-in-part of Ser. No. 72,145, Jul. 10, 1987, Pat. No. 4,832,675.

[51] Int. Cl.[4] ..... B31B 3/62; B31B 1/44

[52] U.S. Cl. ..... 493/124; 493/128; 493/151; 493/169

[58] Field of Search ..... 493/123, 124, 128, 143, 493/151, 167, 169, 902, 912

[56] References Cited

U.S. PATENT DOCUMENTS

| | | | |
|---|---|---|---|
| 3,618,482 | 11/1971 | Bowman . | |
| 3,854,385 | 12/1974 | Wallin | 93/36 |
| 4,256,025 | 3/1981 | Goda et al. . | |
| 4,289,491 | 9/1981 | Collura et al. . | |
| 4,295,839 | 10/1981 | Baker et al. | 493/143 |
| 4,637,811 | 1/1987 | Fortney | 493/167 |

FOREIGN PATENT DOCUMENTS

| | | |
|---|---|---|
| 164585 | 12/1985 | European Pat. Off. . |
| 985076 | 3/1965 | United Kingdom . |
| 1385295 | 2/1975 | United Kingdom . |

*Primary Examiner*—Robert P. Olszewski
*Assistant Examiner*—Jack Lavinder
*Attorney, Agent, or Firm*—Dennison, Meserole, Pollack & Scheiner

[57] ABSTRACT

In apparatus for the formation of a planar blank into a flanged dual-compartment container, an inclined feeder with a generally vertical discharge end at which the blanks are sequentially presented for transfer. Vertically reciprocating glue applicators are mounted forward of the discharge end for depositing glue on the leading blank prior to transfer. A transfer unit is positioned forward of the discharge end for transfering the blank to a posiition overlying a forming chamber and introducing a central fold therein. Opposed upwardly projecting retention bars are mounted over the forming chamber for engaging and retaining the fold. Dual forming heads vertically reciprocate over the forming chamber to engage the blank into the forming chamber and define dual compartments. The dual forming heads are of different heights and mount a flange setter assembly for vertical reciprocation therewith and relative thereto. The setter assembly includes different height flange setting bars peripherally about each forming head, the different height of the setting bars corresponding to the difference in height to the forming heads.

19 Claims, 6 Drawing Sheets

FIG. 2
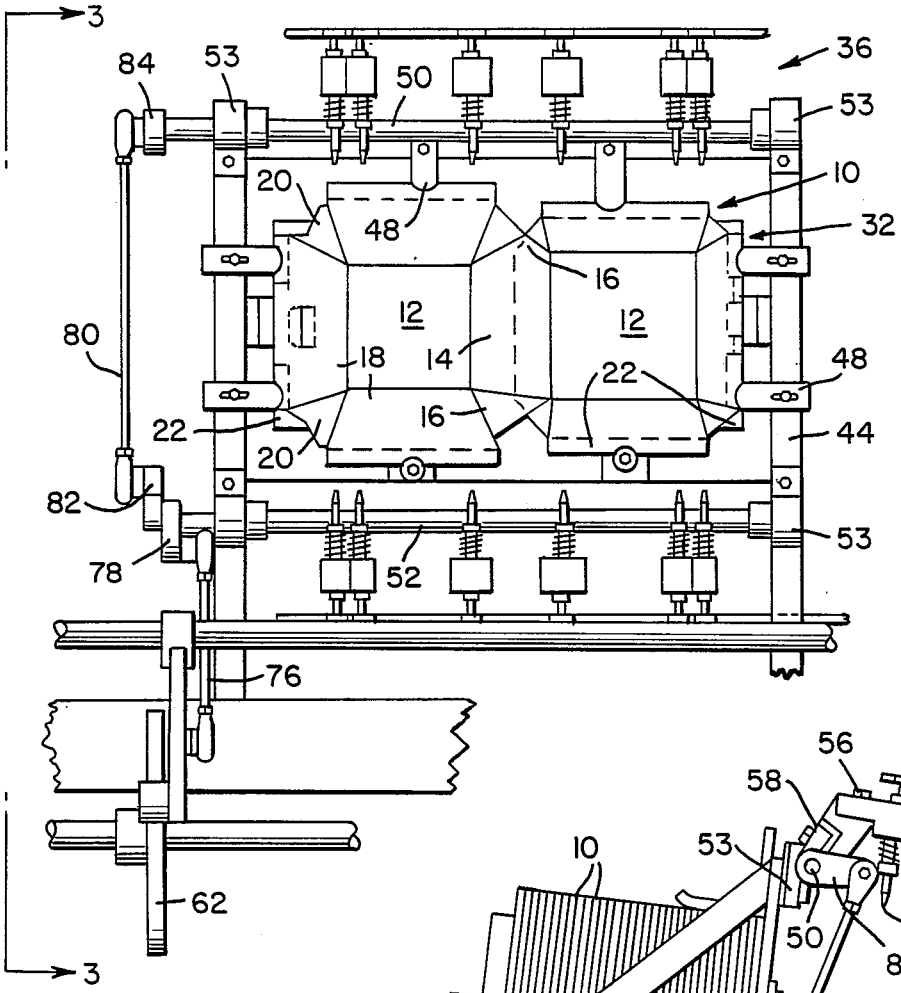
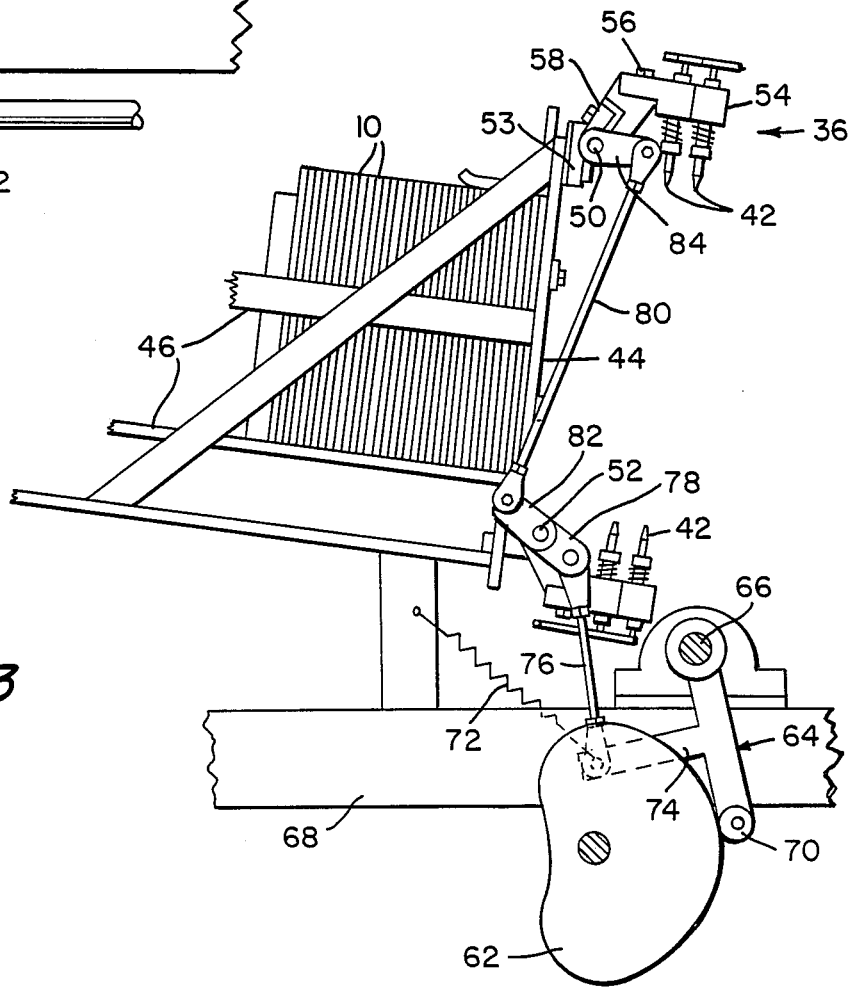
FIG. 3

CARTON FORMER

This is a continuation-in-part of application Ser. No. 072,145; Stearns et al; filed on July 10, 1987 now Pat. No. 4,832,675. The disclosure of the parent application is herein incorporated by reference.

BACKGROUND OF THE INVENTION

The folded cardboard trays or clamshell cartons commonly used in "fast food" packaging have basically consisted of a compartment or compartments defined by a flat bottom with peripheral walls either perpendicular to the bottom or angled slightly outward relative to the vertical. The formed tray is adapted for use either as an open container or to receive some form of closure. The clamshell carton basically comprises two generally equal size walled chambers hingedly connected for pivotal closing of one upon the other.

Apparatus for high speed automated formation of such containers is known. In one form of apparatus, flat diecut blanks of paperboard or cardboard are held in a magazine feeder for a gravity feeding of the blanks toward a discharge end of the feeder. One or more vacuum plates, pivotally mounted on a swing arm, pull the blank from the magazine feeder, rotate the blank to a horizontal position, and lower the blank on the top of a compression or forming chamber.

After positioning the blank on the top of the compression chamber and retraction of the vacuum plate, glue tips rotate downward to apply glue at defined points, four in a single compartment tray and eight in a dual compartment clamshell carton. Upon a retraction of the glue tips, a forming head lowers to push the blank through the top of the compression or forming chamber, inwardly folding the blank to overlap the glue points and define the tray or carton. As the formed container moves into the forming chamber it nests into the container folded immediately prior thereto. The sides of the forming chamber are defined by vertical smooth cylindrical rods which retain the formed containers as the containers, whether trays or cartons, are progressively moved downward as each succeeding container is formed. The formed containers are ultimately discharged from the bottom of the forming chamber with the duration of the time within the forming chamber being sufficient to allow the glue to set.

SUMMARY OF THE INVENTION

The present invention is broadly concerned with improved folded paperboard containers wherein the containers, primarily multiple compartment clamshell cartons, include peripheral laterally projecting edge flanges for enhanced sealing and increased strength, possibly allowing for the use of lighter caliper board.

More specifically, the invention is concerned with apparatus particularly adapted to automatically and at high speed form flanged folded paperboard containers from diecut blanks. The apparatus of the invention modifies the known apparatus, heretofor used in the formation of containers without flanges, to accommodate blanks with flange-forming end panels and manipulate the individual blanks to form the blank into a flanged container. Basically, the apparatus applies glue to a blank while still in the magazine feeder; removes the planar blank and defines a central partition and hinge transversely thereacross as the blank is positioned over the forming chamber; and prebreaks or prefolds the flange panels of the positioned blank to define peripheral flanges. The apparatus subsequently moves the positioned blank into the forming chamber, forming the compartments and bringing the flanges into gluing position. Pressure is applied to the formed flanges as the containers are nested within the forming chamber with the forming chamber itself incorporating means for directly engaging the flanges and retaining the formed containers.

In the operation of the apparatus, as each blank arrives at the discharge end of the magazine feeder, the glue tips rotate to apply glue thereto. The stacked blanks within the feeder define a stable base against which the glue tips act to effect proper glue application on the forwardmost blank.

Subsequent to application of the glue, the planar blank is engaged and removed by a pair of transfer heads which inwardly shift relative to each other to centrally fold the blank and define both a central partition and a hinge between two planar portions. Simultaneously therewith the blank is rotated to overly the forming chamber. As the blank is seated over the forming chamber, a pair of retention bars engage the central fold to stabilize the fold and position the blank.

Once positioned, breaker bars or rods descend to engage and fold the flanges, along the three edges of each planar portion, out of the plane of the blank about fixed breaker blocks. The breaker rods retract as a pair of forming heads lower, engage the two planar portions, and push the blank through the top of the forming chamber to form the container compartments. As the container moves into the forming chamber, it nests within the previously folded container. As the forming heads reach the bottom of their vertical stroke, a flange final-set assembly associated with each forming head moves vertically downward to engage and set the formed flanges in the correct position for nesting and glue bonding. The forming heads, incorporated into an assembly for simultaneous manipulation, are separately formed and mounted, and are normally of different dimensions. In this manner, provision is made for accommodating variations in the blanks for different packaging environments, for example wherein the two planar portions are sized to form different depth container compartments. The side walls of the forming chamber include vertically elongate rectangular bars with inner faces having horizontal serrations along substantially the full height thereof for directly engaging the outer edges of the flanges and retaining the formed containers as they are sequentially moved downward as each subsequent container is formed.

The apparatus of the invention provides features which modify, improve and so adapt the known forming apparatus as to provide for a unique accommodation of flanged blanks and the formation thereof into flanged dual-compartment containers without affecting the speed of operation of the apparatus and while enhancing major operational functions of the known apparatus.

Particular objects and advantages of the invention will be better appreciated from the details of construction and operation as more fully hereinafter described.

BRIEF DESCRIPTION OF DRAWINGS

FIG. 2 is a front elevational view of the discharge end of the magazine feeder with the associated glue applying assembly retracted;

FIG. 3 is a side elevational view taken substantially on a plane passing along line 3—3 in FIG. 2;

DESCRIPTION OF PREFERRED EMBODIMENT

Figure 1:
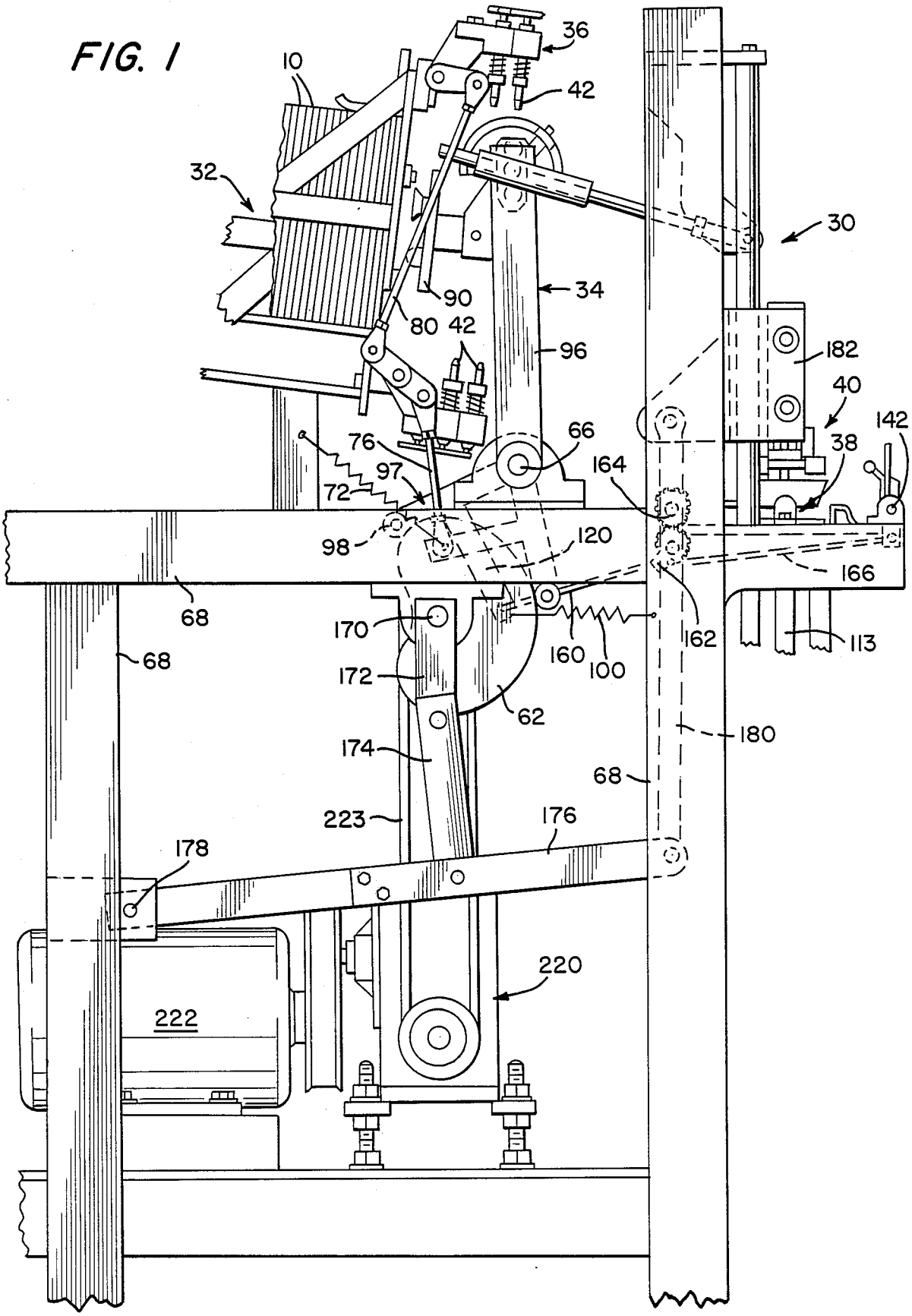
FIG. 1 is a side elevational view of the overall apparatus with the vacuum transfer assembly positioned to engage a blank.

In accord with known technology, formation of a container from a planar blank is normally effected by automated apparatus. Basically, the apparatus includes an inclined feed magazine for the gravity feed of blanks, a pivotally mounted vacuum transfer head for removing individual blanks and positioning the blanks in overlying relation to a forming chamber, glue applicators for applying glue to the wall panels prior to folding of the blank, and a forming head. The forming head is synchronized with the vacuum transfer head and activated upon retraction of the transfer head to forceably engage the blank and move the blank into the forming chamber with the side walls of the chamber, in the nature of elongate smooth cylindrical rods, inwardly folding the walls of the blank with the glue tabs positioned for an adhesive bonding of the walls in their erected position. Each of the containers, formed by the descending forming head, seats within and is retained in the formed configuration by the previously formed containers with the stack of formed containers ultimately discharging below the pressure chamber into an appropriate discharge chute or the like. The period of movement of the blanks through the forming chamber is such as to allow for a complete setting of the glue prior to discharge.

The present invention is concerned with unique modifications to the known apparatus to specifically adapt the apparatus to form a flanged container using high speed manufacturing techniques. This flanged container, formed of folded paperboard or the like, will preferably be in the nature of a two compartment clamshell carton.

The dual-compartment container is formed from a planar blank 10 including a pair of planar bottom panels 12 with a folding partition panel 14 therebetween to define an inner wall 15 for each compartment with an integral hinge therebetween. The partition panel 14 includes four glue flaps 16 comprising generally triangular extensions at the opposed ends of the two inner walls 15. The blank 10 further includes wall-defining peripheral panels 18, with corner glue flaps 20, integral with the bottom panels 12 along defined fold lines. Peripheral flange-defining panels 22 are integrally joined along the outer edges of the wall panels 18 along appropriate fold lines.

The apparatus 30 used in the formation of the dual compartment containers is illustrated in side elevation in FIG. 1 and includes an inclined gravity feed magazine 32 for the planar blanks 10, vacuum transfer head assembly 34, glue applicator assembly 36, compression or forming chamber 38, and forming head assembly 40.

The apparatus 30 differs from the prior art apparatus in several significant aspects associated with the formation of the dual-compartment container, the application of glue, etc., all as will be described subsequently.

As seen in FIG. 1 and more specifically detailed in FIGS. 2–5, the glue applicator assembly 36 is positioned and operatively controlled to apply glue to the leading blank 10 of the stack of blanks within the feeder magazine 32 immediately prior to discharge of the blank therefrom. Application of the glue at this position in the apparatus 30, preliminary to discharge of the blank and the subsequent formation thereof into a container, is significant in that the individual glue tips 42 normally including ball valves of the type which automatically open upon engagement with a firm surface. The feeder-loaded blanks provide a firm planar base for the leading blank and a stable surface to ensure proper glue application.

The feeder 32 is positioned at a sufficient incline to assure a continuous downward feeding of the stacked blanks 10 toward a forward frame 44 defining the mouth of the feeder 32. The feeder itself will include both bottom and side rails 46 aligning and guiding the stacked blanks 10.

The blanks 10, at the leading or discharge end of the feeder 32, are releasably retained by a series of plate-like slotted retaining fingers 48 adjustably bolted to the forward frame 44 and overlapping the edges of the leading blank 10 at selected points thereabout to retain the blank until the blank is forceably removed, at which time the immediately following blank is retained, along with the stacked blanks inward thereof.

The glue tips or nozzles 42 are provided in upper and lower banks respectively mounted on upper and lower shafts 50 and 52 rotatably mounted by pairs of pillow blocks 53, on and transversely across the upper and lower portions of the frame 44 immediately above and below the discharge or forwardmost end of the feeder 32. As illustrated, the nozzles 42, either singly or in pairs, project from appropriate mounting blocks 54 which adjustably mount, through a bolt and slot means 56, on rigid arms 58 which are in turn slidably and rotatably adjustable on the corresponding shaft 50 or 52. The arrangement of the nozzles 42 is of course dictated by the shape of the blanks and the position of the glue flaps associated with both the carton side walls 18 and the flanges 22. Inasmuch as the glue is applied to the blanks while the blanks are completely planar, there is no alignment problem nor is there any necessity for other than the two banks of simultaneously pivoting glue nozzles to effect complete glue application, notwithstanding the ultimate angular relationship between the various container panels in the erected container.

Figure 4:
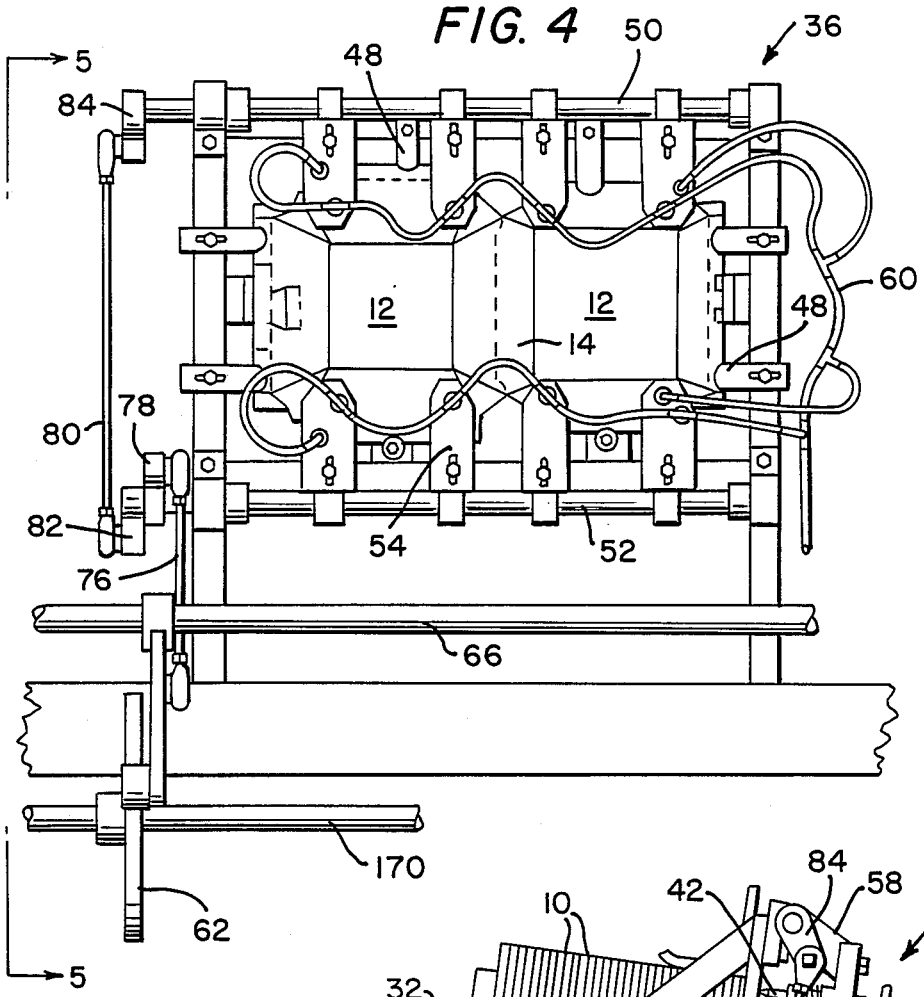
FIG. 4 is a front elevational view similar to FIG. 2 with the glue applying assembly operatively engaged with the leading blank.
Figure 5:
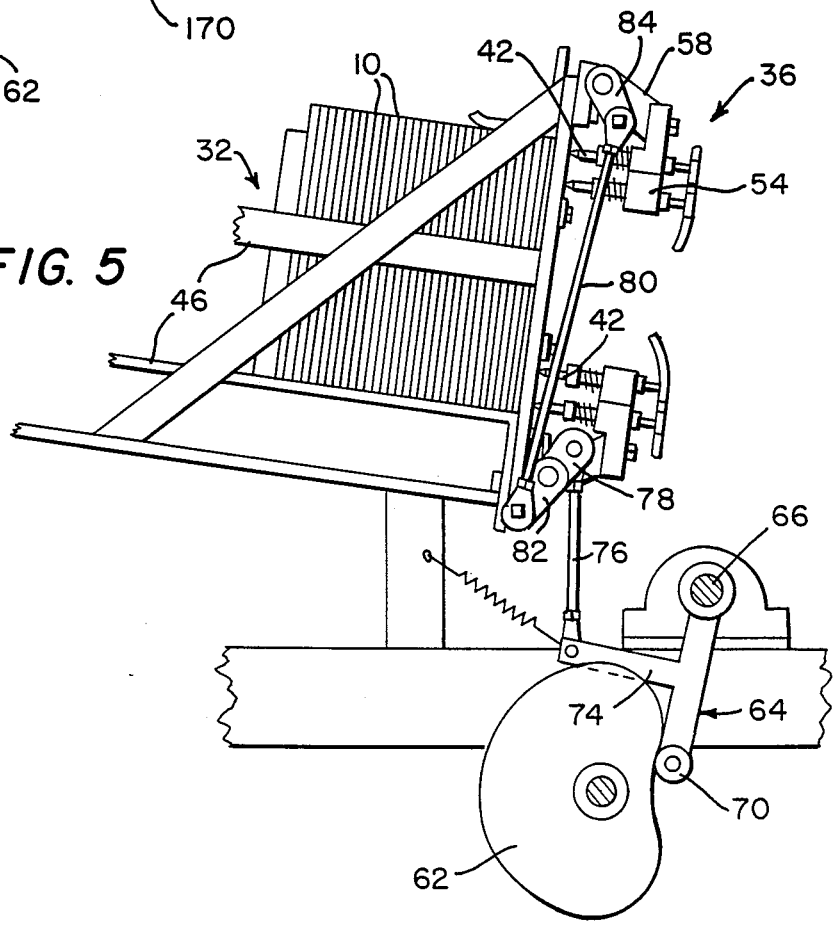
FIG. 5 is a side elevational view taken substantially on a plane passing along line 5—5 in FIG. 4.

As best seen in FIG. 4, the glue nozzles are continuously supplied with glue through an appropriate pressurized system incorporating a series of flexible glue lines or conduits 60 positioned to accommodate the pivotal movement of the nozzles.

Operation of the glue applicator assembly is controlled by a shaft-mounted driven kidney-shaped cam 62. A T-shaped crank or link 64 has one end thereof rotatably mounted to an elongate shaft 66 positioned transversely across the support frame 68 forward of and below the discharge end of the feeder 32 and the associated glue applicator assembly 36. Oscillation of the crank 64 is controlled by a cam follower 70 riding on the cam 62 and resiliently biased thereagainst by an elongate tension spring 72 engaged between an appropriate point on the apparatus frame 68 and the outer end of laterally extending crank arm 74.

A link rod 76 is pivoted at one end to the outer end of the crank arm 74 and extends therefrom to a pivot arm 78 fixed to the lower glue applicator shaft 52 for oscillation thereof to selectively pivotably or rotatably engage and retract the associated glue nozzles 42. The second or upper shaft is simultaneously oscillated by means of a tie rod 80 having the lower and upper ends thereof respectively pivoted to lower and upper pivot arms 82 and 84 rigid with the shafts 52 and 50. As desired, the link rod assemblies can be duplicated at the opposite ends of the shafts 50 and 52. With intimate engagement of the follower 70 with the cam 62 provided by the tension spring 72, the rotational driving of the cam 62 will provide a timed oscillation of the glue applicator assembly which is coordinated with the operation of the vacuum transfer head assembly 34 to effect a withdrawal of the leading blank immediately subsequent to application of the glue thereto and retraction of the glue nozzles.

The vacuum head transfer assembly 34, in the illustrated embodiment wherein a two-compartment container is to be formed, includes two vacuum transfer heads 90 mounted on a pair of spaced parallel shafts 92 transversely across the apparatus forward of the feeder 32. The shafts 92 are pivotally affixed through mounting blocks 94 to the outer ends of a pair of pivot arms 96, the opposed ends of which are rigid with the shaft 66 for oscillation therewith. Oscillation of the shaft 66, and hence the transfer head assembly, is effected through the kidney-shaped cam 62 and a rigid link or crank 97. The crank 97 includes a cam follower 98 maintained in intimate engagement with the cam 62 by appropriate spring means, for example tension spring 100 engaged between a crank arm 102 and the apparatus frame 68.

Figure 6:
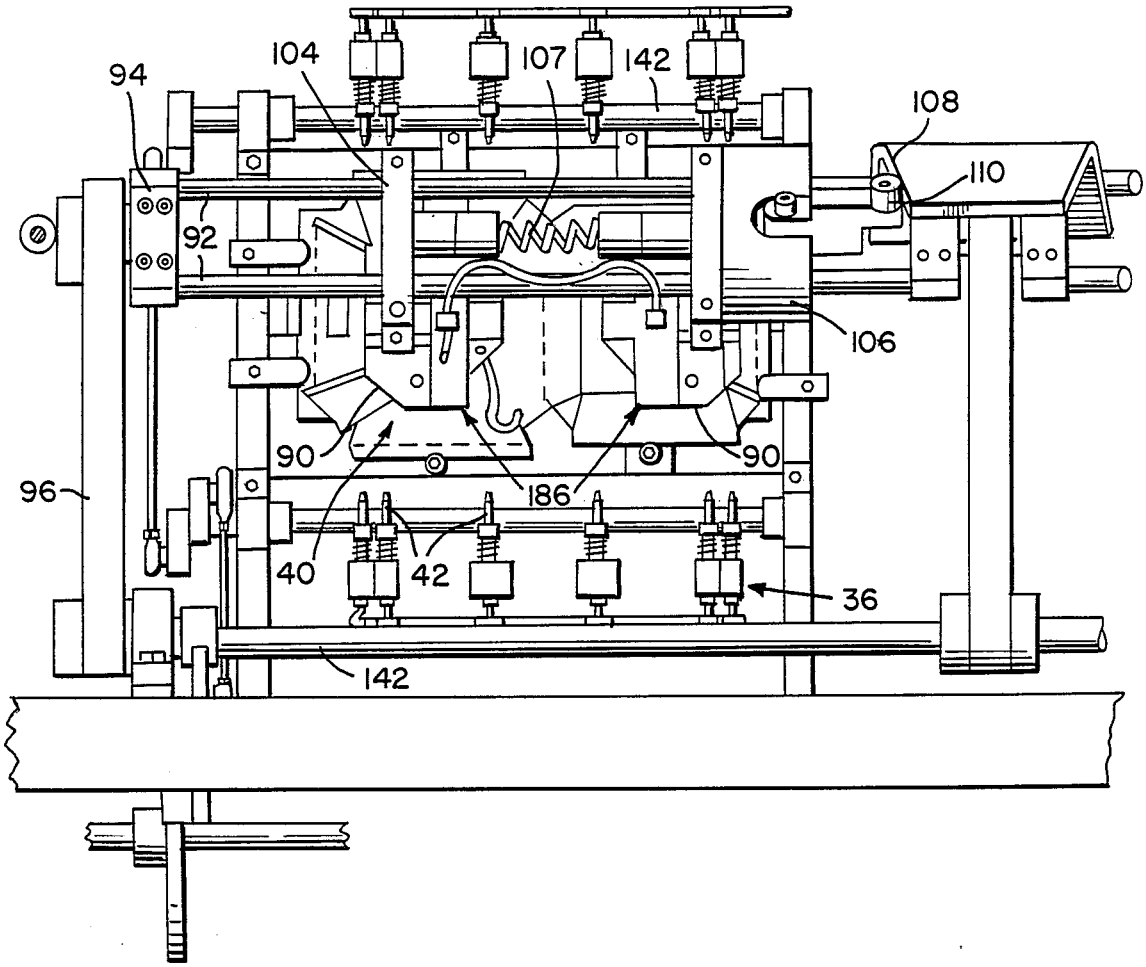
FIG. 6 is a view similar to FIG. 2 wherein the glue applying apparatus is retracted and the transfer assembly for the blanks is engaged.
Figure 7:
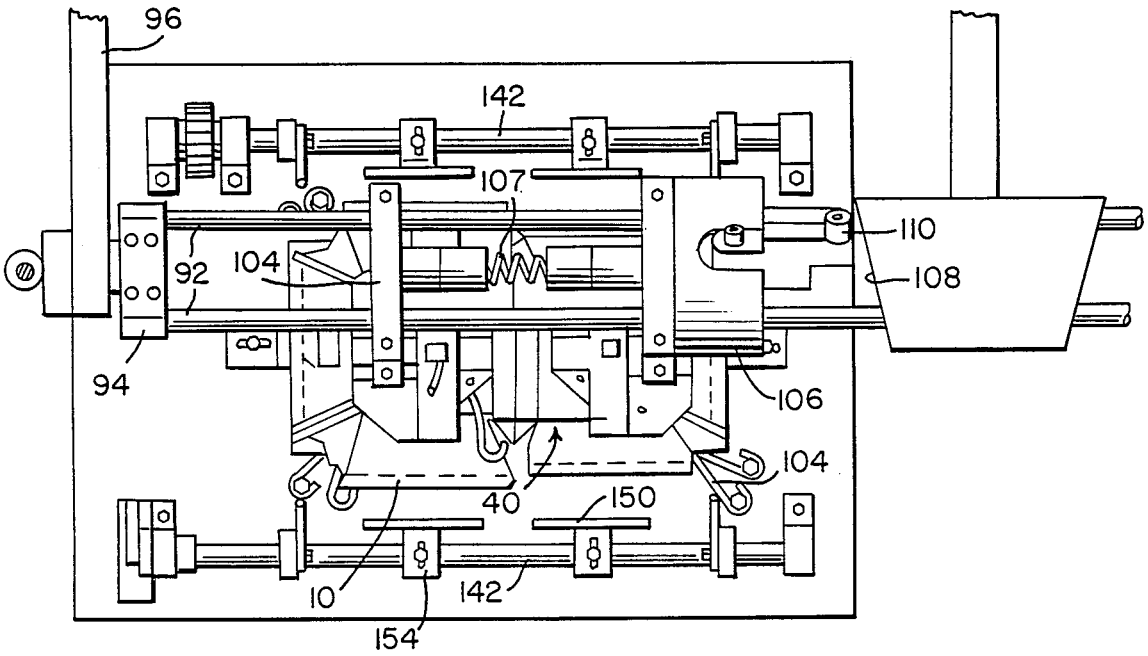
FIG. 7 is a plan view illustrating positioning of the blank over the forming chamber by the transfer assembly.

Noting FIGS. 6 and 7, one of the transfer heads 90, the left-hand head as illustrated, is adjustably fixed to the mounting shafts 92 by a mounting assembly 104. The second or right-hand transfer head 90 is slidably mounted on the shafts 92 by a sliding mounting assembly 106 for controlled movement toward and away from the left-hand transfer head. The transfer heads are resiliently biased apart by a compression spring assembly 107 engaged between the mounting assemblies 104 and 106 of the two transfer heads. Movement of the right-hand mounting assembly 106 and corresponding transfer head 90 toward the left is controlled by a cam 108 immediately outward of the mounting assembly 106 and a cam follower 110 engaged with the cam and mounted on mounting assembly 106 in a manner whereby engagement between the follower 110 and the cam 108 will effect a controlled sliding movement of the right-hand mounting assembly 106 and the associated transfer head 90 relative to the left-hand transfer head.

The transfer head assembly as broadly described is known. Basically, the vacuum transfer heads will engage the leading blank in the magazine feeder, remove the blank from the feeder, pivot the blank horizontally, moving the two compartment-forming portions of the blank inwardly relative to each other (actually moving the right-hand portion inwardly relative to the left-hand portion) to define the central partition and hinge fold, and finally depositing the blank in overlying relation to the forming chamber 38. The transfer head assembly is then retracted to allow for operation of the forming head assembly and to repeat the transfer operation. A subsequent blank, during the transfer of the preceding blank, will have had the glue applied thereto preparatory to transfer. Incidentally, and as will be appreciated from FIGS. 1, 6 and 7, in transferring the blanks from the magazine feeder 32 to the forming chamber 38, the blanks are moved from a substantially vertical position to a horizontal position through an appropriate controlled pivoting of the vacuum transfer heads 90 in accord with known automated manipulative steps.

Figure 8:
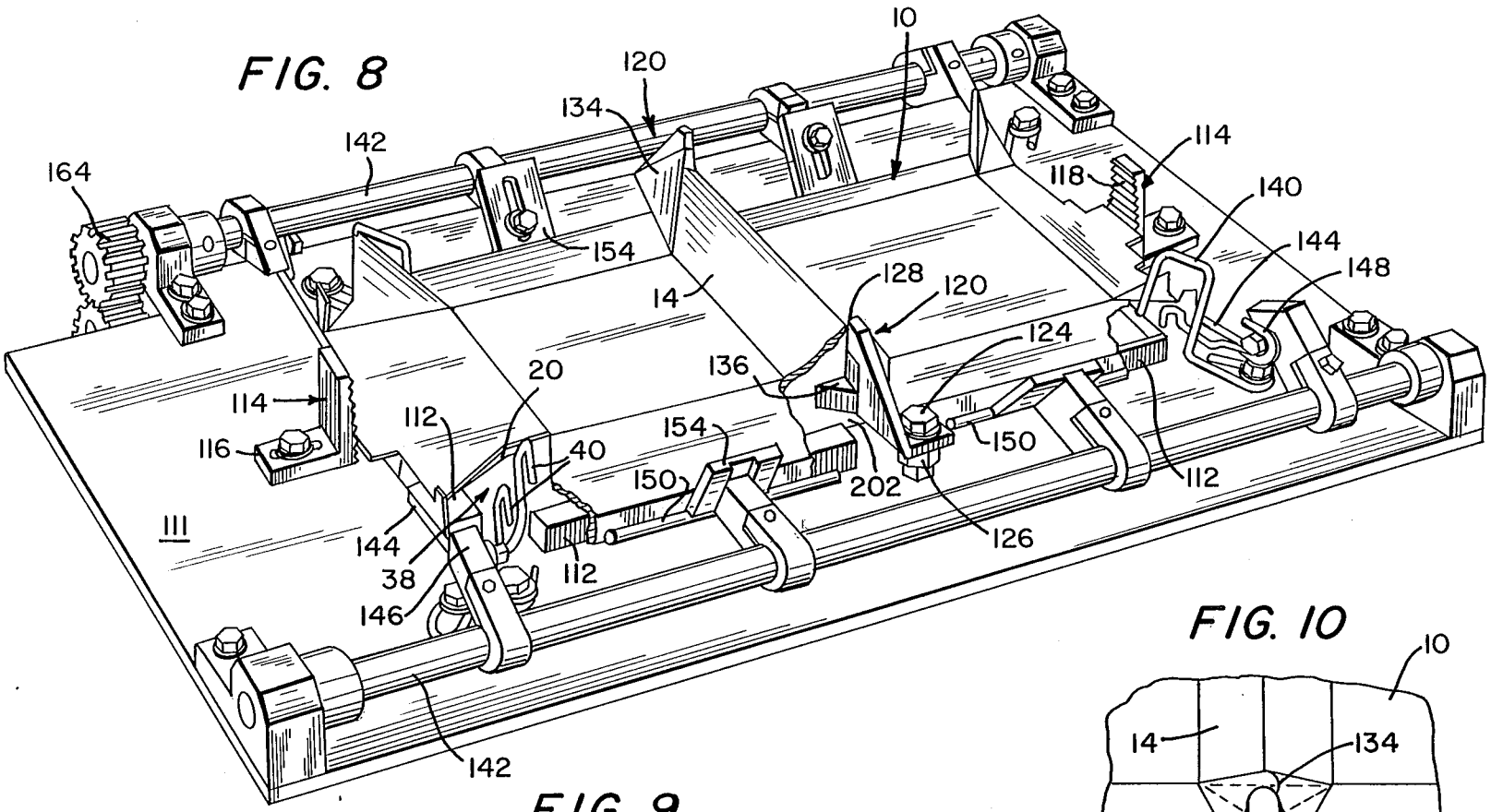
FIG. 8 is a perspective view of the forming base with a blank positioned over the top of the forming chamber preparatory to engagement by the forming assembly.

Attention is now directed to FIG. 8 which illustrates the forming chamber 38 opening upwardly through a base plate 111 and with a blank 10 positioned thereover. The chamber 38 is generally rectangular and has the open upper end thereof defined by shoulder or breaker blocks 112 fixed to the base 111 and having coplanar upper surfaces for the support of a blank 10 thereon. The blank 10 will be positioned on block 112 with the peripheral flange panels 22 projecting therebeyond.

The forming chamber 38 below the base plate 111 is defined by a series of vertically depending flat bars 113 having a series of horizontal serrations vertically along the inner faces thereof. The serrated bars 113 are arranged to define the basic rectangular configuration of the forming chamber 38, normally at least three such bars being provided along each side of the chamber. The serrations are specifically provided for cooperative engagement with the formed containers for a retention thereof.

In order to assist in properly locating the blanks 10 on the breaker blocks 112 in overlying relation to the forming chamber 38, a pair of opposed blank locators 114 are provided, one centrally along each end or short side of the chamber opening immediately outward of the corresponding breaker block 112. Each locator 114 is basically an angle member with the horizontal leg 116 bolted to the base 111 and with the vertical leg 118 adjacent the corresponding breaker block 112. The inner faces of the vertical legs 118 of the locators 114 are provided with a series of serrations, to engage the outer edge portions of the blanks 10 to stabilize the blanks as the transfer head assembly 34 is withdrawn and prior to engagement of the forming assembly 40. As desired, the horizontal leg 116 of each locator 114 may include an elongate slot therein receiving the mounting bolt to provide for a degree of adjustability in positioning the locator.

With continued reference to FIG. 8, the blanks 10 are further stabilized and properly oriented over the forming chamber 38 by a pair of centrally located, opposed, generally triangular retention bars 120. These retention bars 120 are vertically oriented and located in transverse alignment with each other to engage the prefolded partition panel 14 of a blank 10 to assist in properly positioning the blank 10 and more particularly to retain the pre-formed configuration of the partition panel 14 subsequent to the removal of the vacuum transfer heads 90 until such time as the forming assembly 40 engages the blank. In addition, the bars 120 are so configured as to predispose various panel elements of the blank 10 to ensure a proper overlapping in the folded container as the blank moves into the forming chamber 38.

Figure 10:
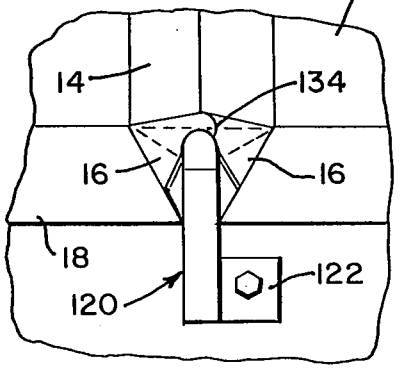
FIG. 10 is a plan view an the retention bar in operative engagement with a blank.
Figure 9:
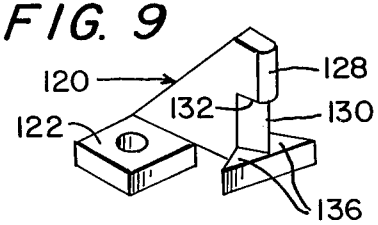
FIG. 9 is a perspective detail of one of the triangular retention bars utilized in defining the central fold of the blank.

With continued reference to FIG. 8 and also noting FIGS. 9 and 10, each bar 120 is positioned with the vertical edge thereof inwardly directed and with the upper edge thereof sloping rearwardly and outwardly to meet the horizontal base edge, at which point a laterally directed apertured mounting lug 122 is provided. The lug 122 associated with each angle bar 120 is adapted to receive a mounting bolt 124 therethrough. The base or base plate 111, as desired, may include an elongate slot to provide for a degree of adjustability to the position of the corresponding angle bar 120. Further, and as suggested in FIG. 8, appropriate spacers 126 can be provided between the lug 122 and the base 111 to provide for an adjustment in the height of the retention bar for accommodation of different height folds of the partition panel 14.

The forward edge of each bar 120 includes an upper rounded nose portion 128 and a lower relatively sharp edge portion 130 with angled side faces which provide undercut portions and define a pair of overhanging shoulders 132 to each side of the nose portion 128 and immediately therebelow. So configured, the opposed open outer ends of the folded partition panel 14 will engage and slide downwardly over the rounded nose portions 128, effecting a deflection of selected corner tabs 134. As the folded partition panel moves below the nose portion 128, the slightly outwardly flaring ends of the folded partition panel 14 will engage the shoulder-forming overhanging portions 132, in effect snapping thereunder due to the inherent resiliency of the material of the blank. When so positioned, upward movement of the blank, and more particularly the folded partition panel portion thereof, is effectively precluded, this in turn also ensuring a retention of the pre-folded configuration of the central portion of the blank.

Immediately below the leading or forward vertical edge of each bar 120 and extending rearwardly thereof to a depth generally equal to the depth of the angle side faces associated with the lower edge portion 130 is a pair of positioning wings 136. The wings 136 are of generally triangular configuration with a common vertical planar face in the plane of the forward edge, and angled rear vertical faces. These wings 136 engage the central glue flaps 16 associated with the central partition panel 14 to effect a sufficient outward flexing or predisposition thereof to ensure a proper overlapping as the blank is folded into the forming chamber 38 and as the blank moves downward past the wings 136. Thus, it will be recognized that the opposed retention bars 120 perform multiple functions in accommodating the blanks for forming in a high speed operation and notwithstanding the rather complex nature of the various folding operations. Such functions include a positioning of the blank, a retention of the central partition in its pre-folded position, and a folding and/or predisposing of selected glue flaps, connector tabs and the like to ensure a proper overlapping relationship thereof as the formation of the carton is completed.

Again referring to FIG. 8, in order to properly position the outer glue tabs 20 and the glue flaps associated with the edges of flange panels 22, prior to a folding of the blanks, a pair of deflectors 140 are provided at each of the corners of the chamber 38, projecting upwardly of the open upper end thereof immediately inward of and generally parallel to the end breaker blocks 112. As required, the longer side breaker blocks can terminate short of the end breaker blocks at the corners of the chamber mouth to define small gaps for the accommodation of the deflectors 140.

Each of the deflectors 140 is in the nature of a rigid bent rod having a slot-defining foot portion which is secured to the base 111 by appropriate bolt means for a degree of adjustment limited by the length of the defined slot. Each of the rods in turn include an upwardly arcing deflecting portion extending inwardly into overlying relation to the chamber mouth and positioned to respectively engage corresponding glue tabs 20 and flange flaps as the blank 10 is being deposited on the planar upper surfaces of the breaker blocks 112 and over the forming chamber 38. As with the central retention bars 120, the deflectors 140 simultaneously upwardly deflect the outer glue flaps to a degree which is sufficient to ensure a proper positioning and overlapping of the side walls and flange corners.

As a step immediately preceeding engagement of the forming head assembly 40, the edge flanges 22 of the blank are pre-folded over the breaker blocks 112. In order to effect this, a pair of elongate shafts 142 are rotatably supported in overlying relation to the base 111 in outwardly spaced parallel relation to the opposed longitudinal sides of the chamber 38.

The shafts 142 are simultaneously operative with each shaft having a pair of end breaker bars or rods 144 mounted thereon for both longitudinal and rotational adjustment by means of appropriate clamping blocks 146. Each end breaker rod 144 is slidably adjustable relative to the clamping block 146 by an appropriate clamping bolt 148 to both rotatably and longitudinally adjust the specific position of the breaker rod 144. The operative portion of each of these ends breaker rods 144, that is the portion beyond the slot-defining mounting end, is substantially linear and adapted, upon rotation of the corresponding shaft 142, to pivot downwardly immediately adjacent the outer vertical face of the corresponding end breaker block 112, thus engaging and downwardly breaking the corresponding end flange 22 of the blank 10. As will be appreciated from the drawings, each of the end breaker rods 144 terminates short of the central blank locators 114 while at the same time being of sufficient length to ensure a complete downward breaking of the corresponding flange. This breaking of the flanges is facilitated by appropriate score lines or fold lines defined in the blank itself.

The flanges 22 of the blank 10 along the elongate sides thereof are downwardly folded or broken by a pair of intermediate breaker rods 150 oriented parallel to each shaft 142 and adjustably mounted thereon through appropriate clamping blocks 152. Each of the intermediate rods 150 is rigidly secured, as by welding, to a laterally projecting slotted mounting plate 154 which is adjustably bolted to the inclined upper end face of the corresponding clamping block 152. Each rod 150 is positioned and adjusted, through the adjustable plate 154 and adjustable clamping block 152, whereby upon a rotation of the shafts 142 the rods 150 will pivot downwardly to engage the corresponding edge flanges 22 immediately outward of the corresponding side blocks 112 for a downward breaking or folding of the flanges, as illustrated in FIG. 8. In order to provide for a proper breaking of the flanges 22, the breaker blocks 112 should be of a height at least as great as the transverse height of the flanges 22.

The use of the two breaker rods 150 and the adjustability thereof is significant in accommodating differences in the lateral spacing of the corresponding breaker blocks 112 as dictated by the width of the container compartments to be formed, and differences in width between two compartments of the same container as suggested by the illustrated blanks in FIGS. 2, 7, 8 and 12.

Noting FIG. 1, timed oscillation of the shafts 142 is effected by the cam 62 through the link arm 102, rigid with the follower-controlled link 97. Basically, an elongate link rod 160 extends from the outer end of the link arm 102 to a pivot link 162. The pivot link 162, through an appropriate mounting shaft and reversing gear assembly 164, oscillates a first one of the shafts 142. The second shaft 142 is simultaneously oscillated by means of a tie rod assembly 166 engaged therewith for simultaneous coordinated pivoting of both of the opposed breaker rod assemblies.

The control cam 62 mounts on the main drive shaft 170 which, as it rotates, also provides for the timed reciprocation of the forming head assembly 38. Basically, and as suggested in FIG. 1, a first link 172 is rigid with the main drive shaft 170 at one end thereof. A second link 174 is pivoted to the outer end of the first link 172 and in turn pivoted to an elongate transverse link 176 which has a first end pivoted, as at 178, to the frame 68 of the apparatus and the second end pivoted to the lower end of a vertical rod 180. The upper end of the rod 180 is secured to a vertical slide 182 which mounts the forming head assembly 38 for reciprocation in timed sequence. As desired, the linkage arrangement can be duplicated at the opposite end of the shaft 170.

Figure 11:
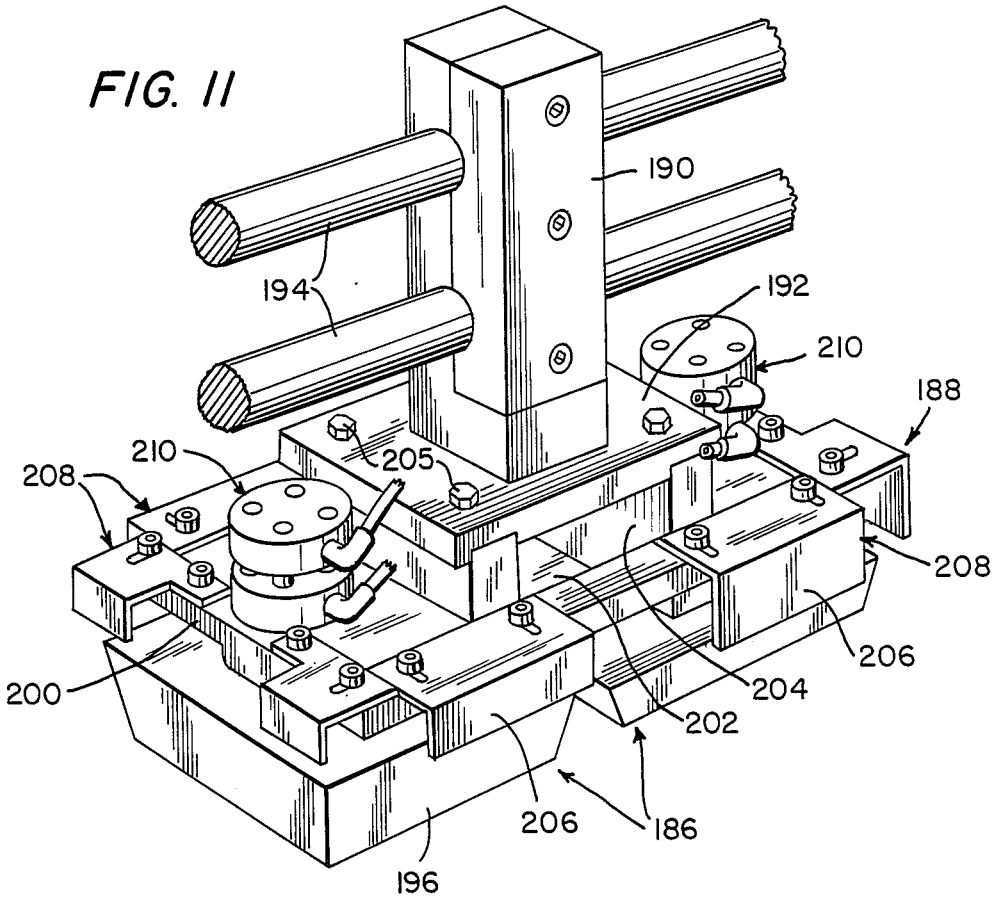
FIG. 11 is a perspective view of the forming assembly incorporating dual forming heads.

Subsequent to the initial downward breaking or forming of the flanges 22 by the breaker rods 144 and 150, the blank 10 is folded into its container configuration, bringing the glue tabs and the flange glue flaps into bonding engagement through the previously applied glued spots or areas, with the corresponding overlying wall and flange portions. Noting FIGS. 11 and 12 in particular, the forming assembly 40 includes dual forming heads 186 simultaneously operationally controlled in generally the same manner as conventional single forming heads utilized in the formation of folded containers without flanges. The forming assembly 40 of the invention uniquely differs from the known apparatus in the manner in which both the dual forming heads 186 and the associated flange setter assembly 188 are formed and mounted for replacement in accord with the specifics of the container, and in particular the compartments thereof, to be formed.

The forming assembly 40 includes a support shaft or column unit 190 depending from a pair of horizontal shafts 194 on the vertical slide 182 for vertical reciprocation of the forming assembly. The base of the column unit 190 includes a horizontal mounting plate 192 thereon.

Figure 12:
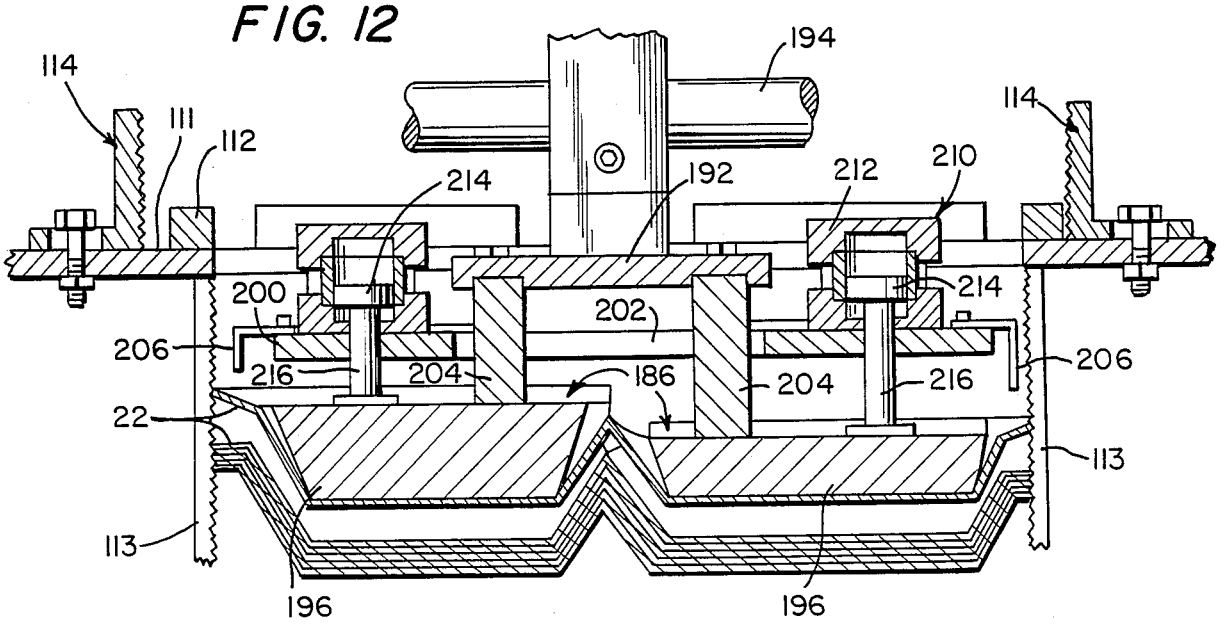
FIG. 12 is a longitudinal cross-sectional view through the assembly of FIG. 11.

Each forming head 186 includes a container shaping block 196. The configuration of each shaping block 196, for example the height thereof as illustrated, is determined by that of the blank and the compartment to be formed therefrom. In order to properly and simultaneously engage the blank, the shaping blocks will have substantially coplanar lower surfaces. With reference to FIG. 12, as the forming heads 196 descend toward the supported blank with the prebroken flanges, the blocks 196 engage the bottom panels 12 and progressively downwardly move the blank into the forming chamber 38, inwardly folding the wall panels 18 which simultaneously brings the glue tabs 20 into overlying relation to the previously applied glue. The flange panels 22, in turn, are inwardly drawn with the flap-corners thereof overlapped for adherence by the previously applied glue. As will be appreciated with regard to both the glue tabs 20 and the flange glue flaps, the initial deflection thereof by the deflecting rods 140 assures a proper overlapping.

In order to ensure a proper positioning of the flanges both relative to each other and within the forming chamber 38 until such time as the glue has had sufficient time to properly set, the forming assembly utilizes the flange setter assembly 188. This setter assembly 188 includes a base panel 200 provided in parallel overlying relation to container shaping blocks 196 for vertical movement relative thereto. Noting FIGS. 11 and 12, the base panel 200 will incorporate a central opening 202 therethrough to accommodate a pair of elongate support columns or beams 204. Each beam 204 has a lower end fixed to one of the blocks 196 and an upper end releasably fixed to the mounting plate 192 to depend the blocks 196 therefrom. In order to stabilize the upper elongate ends of the beams 204, these ends can be received within complementing grooves in the undersurface of the mounting plate 192 as illustrated. The columns or beams 204 and base panel aperture 202, will preferably have complimentary rectangular configurations.

The setter assembly 188 includes depending setting bars 206 affixed peripherally about and depending below the edges of the base panel 200 in laterally outwardly spaced relation to the outer peripheral edges of the underlying forming head shaping blocks 196.

The setting bars 206 will normally comprise the vertical legs of angle members 208, the horizontal legs of which overlie the edge portions of the base panel 200 and are adjustably bolted thereto.

Vertical reciprocation of the setter assembly 188 relative to the blocks 196 is effected by means of a pair of fluid or hydraulic assemblies 210. Each assembly 210 includes a cylinder 212 appropriately secured to the upper surface of the base panel 200 and receiving the head 214 of a piston 216 depending vertically therefrom through the base panel 200 and into fixed engagement with one of the shaping blocks 196 whereby selective simultaneous extension and retraction of the pistons 216 relative to the associated cylinder unit 212 will effect a corresponding vertical reciprocation of the setter assembly 188 relative to the shaping blocks 196. The central columns or beams unit 204 of the forming head may provide guidance for the vertical reciprocation of the setter assembly.

In use, after the shaping blocks 196 have initially folded the blank 10 inward of the forming chamber 38, the setter assembly moves downward relative to the shaping blocks 196 either as the shaping blocks continue movement to their lowermost position or subsequent to arrival at their lowermost position. This downward movement of the setter assembly 188 brings the setting bars 206 into engagement with the folded flanges 22 to move these flanges from an upwardly and outwardly inclined orientation naturally assumed as the blank is forced within the forming chamber to a downwardly folded position slightly below the horizontal. So positioned, the flanges 22 are effectively engaged by the serrations on the inner faces of the vertical chamber bars 113 for a positive retention of the flanges with the flaps thereof positioned for adhesive bonding and in a manner precluding any tendency for the newly formed container to vertically rise in the chamber. The final configuration of the container is effected by the nesting of each folded blank within a previously folded blank with the formed containers stacking within the forming chamber and retained for sequential downward movement by the serrated inner faces of the bars 113. While not illustrated, the lower end of the forming chamber 38 ultimately discharges into a collection means, for example a discharge chute, for the completed containers with the dwell time of the containers within the forming chamber being such as to ensure a positive bonding.

As will be best appreciated from FIG. 12, the invention contemplates the formation of dual-compartment cartons wherein the compartments are of different sizes, each sized, for example, for the accommodation of separate components of a sandwich or the like. As illustrated, the left-hand compartment is substantially deeper than the right-hand compartment. Accordingly, the shaping block 196 associated with the left-hand compartment is of a substantially greater depth to accommodate and properly define the higher side walls thereof. The associated setting bars 206, in accommodating the flanges 22 on the taller side walls of the carton 10, are in turn relatively short. With regard to the shallower right-hand compartment, the corresponding shaping block 196 is of a lesser depth, corresponding to the shorter compartment walls. Similarly, the corresponding setting bars 206 are substantially longer to ensure proper engagement with the corresponding blank flanges. The blank itself, as suggested in FIGS. 2 and 6, will be configured in accord with the final shape and depth of the compartments desired, with the shaping head assembly and setter assembly sized accordingly. As such, it is considered particularly significant that the forming head assemblies and setter assembly be replacable either as single unit or through the use of interchangable components. In this regard, the bolt mounting of the columns or beams 204 provides a convenient means for removably mounting both assemblies as a unit in that the beams 204 mount the shaping blocks 196 which in turn, through the piston and cylinder assemblies 210, mount the setter assembly for vertical reciprocation relative to the shaping blocks 196. As an alternative to replacement of the forming head and setter assemblies as a unit, the individual shaping blocks 196 can be separately replaced, as can the individual pistons 216 associated therewith. To facilitate this, it will probably be necessary to fix each piston rod to the associated shaping block for selective disengagement therefrom in an appropriate manner. The cylinder units 212 will preferably be bolt-together units for piston replacement as required. It will be appreciated that the length of the two piston rods 216 is determined by the relative depth of the shaping blocks 196 to maintain a parallel orientation of the setter assembly base panel 200 as the setter assembly is vertically reciprocated. Also, as previously noted, the adjustable bolt mounting of the setting bars 206 provides not only for the positional adjustment thereof but also for use of different depth bars as desired in accord with particular cartons to be formed.

As will be appreciated, the provision for the use of interchangable forming head assemblies and associated setter assemblies greatly enhances the versatility of the basic apparatus in that cartons of different depths, and for that matter of different shapes within specific parameters, can be accommodated in a simple and expeditious manner by a removal of the mounting bolts securing the beams 204 to the mounting plate 192, removing the forming head assembly and setter assembly as a unit, and inserting another unit configured in accord with the blanks used and cartons to be formed. Other minor adjustment and alignment of the carton blanks with the forming chamber can also readily be effected in light of the formation of the corresponding components for ease of adjustment as previously described.

The operating system of the apparatus is driven by a power unit 220, including for example electric motor 222, which rotatably drives the main drive shaft 170 through drive belt 222. The shaft 170, as previously noted, mounts the kidney-shaped cam 62.

Activation of the setter assembly is preferably hydraulic and may be effected by engagement of an appropriate switch operator mounted on the support for the forming head assembly and engagable as the assembly moves downward with an appropriate switch mechanism. The movement of the setter assembly will be synchronized with the forming head. Additional controls, limit switches, reversing switches, and the like will be provided as desired or required.

Formation of flanged containers in accord with the present invention involves a sequence of steps performed by high speed apparatus which automatically folds preformed blanks into finished containers. Initially, an individual blank is fed to a discharge position in a gravity feeder at which position glue is applied thereto. The blank is then withdrawn from the feeder, longitudinally contracted to define a central partition, and positioned horizontally over the forming chamber in supported engagement on peripheral shoulder-defining breaker blocks 112 with peripheral flange panels 22 on the blank projecting beyond the blocks 112. The central partition 14 is stabilized, and the blank 10 retained, by opposed retention bars 120. The projecting flange panels are downwardly folded to depend from the planar blank peripherally thereabout. The blank is then downwardly moved into the forming chamber with the sides of the chamber, in cooperation with the blank-moving forming heads, inwardly folding the walls of the container and bringing the areas to be adhesively bonded into overlapping engagement. As the basic container is being formed, the peripheral flanges are downwardly forced, both ensuring a proper orientation thereof to overlap the areas to be adhesively bonded, and to also position the flanges into container-securing engagement with the serrated inner faces of the forming chamber walls or wall-defining bars. It is contemplated that the formed containers nest within previously formed containers in a continuing operation whereby cooperation therewith and with the flange-retaining serrations provides a container-stabilizing support until such time as the glue has set.

The formed containers progressively travel downward through the forming chamber with the length of travel being such as to ensure a proper setting of the glue. The formed containers are ultimately discharged through the bottom of the forming chamber into, as an example, an appropriate discharge chute.

The foregoing is considered illustrative of the features of the invention as applied to the formation of a dual-compartment container. Modifications as required and within the scope of the invention for variations in container configuration and the like will be apparent to those skilled in the art.

We claim:

1. An apparatus for forming paperboard blanks into containers with depressed central compartments and peripheral flanges, said blanks having peripheral wall-defining panels, said apparatus including feeder means for receiving a stack of blanks and sequentially presenting the blanks in said stack forwardmost for removal therefrom, a forming chamber with an upwardly directed receiving opening, swinging vacuum transfer means for individually transferring the forwardmost blank from said feeder means and positioning said blank over said receiving opening, and vertically reciprocating container forming means for engaging a positioned blank and moving said positioned blank into said chamber with the panels folding upward to define walls; the improvement including glue applicator means for applying glue to said blanks prior to transfer thereof from said feeder means to said forming chamber; and control means for synchronizing the motion of said glue applicator means with the motion of said swinging vacuum transfer means, said control means having a cam and a linking means for selectively engaging said glue applicator means with the forwardmost blank including pivot means mounting said glue applicator means adjacent a discharge end of the feeder means independently of said swinging vacuum transfer means, said pivot means comprising a pair of shafts rotatably mounted outward of said feeder means along opposed edge portions thereof.

2. In the apparatus of claim 1, wherein said feeder means includes a supply magazine receiving said blanks, said magazine being downwardly inclined toward a forwardmost discharge end for sequential feeding of the blanks thereto for removal therefrom by said transfer means; the improvement wherein said glue applicator means includes multiple glue nozzles and means for selectively engaging said nozzles with the forwardmost blank at the discharge end and depositing glue thereon, and drive means for oscillating said nozzles toward the discharge end into engagement with the forwardmost blank in said magazine for deposit of glue thereon and away from said discharge end to expose said forwardmost blank for removal of the forwardmost blank, with glue thereon, from said magazine by said swinging vacuum transfer means.

3. In the apparatus of claim 2 wherein said forwardmost discharge end of said supply magazine is generally vertically oriented and defined by frame means having means for releasably retaining said blanks for selective withdrawal by said transfer means; said nozzles being adjustably mounted on said shafts for rotation therewith, said drive means oscillating said shafts for oscillation of said nozzles toward and away from said discharge end and into engagement with the forwardmost blank thereat.

4. In the apparatus of claim 3 a base plate overlying said forming chamber, said receiving opening of the chamber being defined through said base plate, said transfer means including folding means for defining a partition fold in a transferred blank centrally thereacross as the blank is transferred to said receiving opening; the improvement further including a pair of retention bars fixed to said base plate at points centrally aligned across said receiving opening, said retention bars partially overlying said opening for engagement with the partition fold of a transferred blank to assist in positioning of the blank over the chamber opening.

5. In the apparatus of claim 4, said retention bars including means for retaining a transferred blank over said opening and against upward movement therefrom upon retraction of the transfer means.

6. In the apparatus of claim 5, said retention bars including positioning means in the path of a transferred blank for engaging said blank and deflecting selected portions thereof to encourage proper folding thereof within the forming chamber.

7. In the apparatus of claim 6, each retention bar including a vertical forward edge inwardly directed toward a transferred blank for engagement of the partition fold of the blank thereagainst, said means for retaining a blank against upward movement comprising overhanging shoulder-defining means along said forward edge for receiving the partition fold therebeneath.

8. In the apparatus of claim 7, said positioning means comprising a pair of projections on each retention bar extending laterally to the opposite sides of the forward edge thereof below the shoulder-defining means.

9. In the apparatus of claim 8, said blanks having flange-defining edge panels integral with and outward of said wall-defining panels, flange forming means including flange folding means for engaging and downwardly folding the edge panels of a positioned blank prior to movement of said blank into said chamber, said folded edge panels defining outwardly projecting flanges on the walls upon upward folding of said wall-defining panels; said container forming means comprises forming means comprises dual shaping blocks aligned with the forming chamber opening to the opposite sides of said retention bars for selective engagement with a transferred blank with the partition fold therebetween, for a downward forming thereof into a two-compartment configuration within said forming chamber, one of said shaping blocks being of greater height then the other shaping block to define different depth compartments to opposite sides of the central partition fold.

10. In the apparatus of claim 9, a horizontal mounting plate vertically above said shaping blocks, means removably mounting said shaping blocks to and in depending relation below said mounting plate, said shaping blocks having substantially coplanar lower surfaces, and means for vertically reciprocating said mounting plate for vertical reciprocation of the shaping blocks therewith.

11. In the apparatus of claim 10, flange setter means mounted on and overlying said dual shaping blocks and including depending peripheral setting bars vertically reciprocal relative to the shaping blocks for engagement with the peripheral flanges of a dual compartment container formed by said shaping blocks for a downward movement of said flanges.

12. In the apparatus of claim 11, said setter means including a base panel overlying said shaping blocks, means mounting said setter means base panel on said shaping blocks for vertical reciprocation relative thereto, said setting bars being removably mounted on said base panel and depending peripherally therefrom outward of said shaping blocks, selected setting bars being peripherally associated with each shaping block, the setting bars associated with said one greater height shaping block being vertically shorter than the setting bars associated with the other shaping block for substantially simultaneous engagement with the peripheral flanges of the dual compartment container.

13. In the apparatus of claim 12, said shaping blocks and said setter means being removable from said mounting plate as a unit for replacement.

14. In the apparatus of claim 1, said blanks having flange-defining edge panels integral with and outward of said wall-defining panels, flange forming means including flange folding means for engaging and downwardly folding the edge panels of a positioned blank prior to movement of said blank into said chamber, said folded edge panels defining outwardly projecting flanges on the walls upon upward folding of said wall-defining panels; said container forming means comprises dual shaping blocks aligned with the forming chamber opening for selective engagement with a transferred blank for a downward forming thereof into a two-compartment configuration within said forming chamber, one of said shaping blocks being of greater height then the other shaping block to define different depth compartments.

15. In the apparatus of claim 14, a horizontal mounting plate vertically above said shaping blocks, means removably mounting said shaping blocks to and in depending relation below said mounting plate, said shaping blocks having substantially coplanar lower surfaces, and means for vertically reciprocating said mounting plate for vertical reciprocation of the shaping blocks therewith.

16. In the apparatus of claim 15, flange setter means mounted on and overlying said dual shaping blocks and including depending peripheral setting bars vertically reciprocal relative to the shaping blocks for engagement with the peripheral flanges of a dual compartment container formed by said shaping blocks for a downward movement of said flanges, said setter means including a base panel overlying said shaping blocks, means mounting said setter means base panel on said shaping blocks for vertical reciprocation relative thereto, said setting bars being removably mounted on said base panel and depending peripherally therefrom outward of said shaping blocks, selected setting bars being peripherally associated with each shaping block, the setting bars associated with said one greater height shaping block being vertically shorter than the setting bars associated with the other shaping block for substantially simultaneous engagement with the peripheral flanges of the dual compartment container.

17. An apparatus for forming paperboard blanks into containers with depressed central compartments and peripheral flanges, said blanks having peripheral wall-defining panels, said apparatus including feeder means for receiving a stack of blanks and sequentially presenting the blanks in said stack forwardmost for removal therefrom, a forming chamber with an upwardly directed receiving opening, transfer means for individually transferring the forwardmost blank from said feeder means and positioning said blank over said receiving opening, glue applicator means, and vertically reciprocating container forming means for engaging a positioned blank and moving said positioned blank into said chamber with the panels folding upward to define walls; the improvement wherein said glue applicator means includes multiple glue nozzles and means for selectively engaging said nozzles with the forwardmost blank in the stack for applying glue to said blanks prior to transfer thereof;

a base plate overlying said forming chamber, said receiving opening of the chamber being defined through said base plate, said transfer means including folding means for defining a partition fold in a transferred blank centrally thereacross as the blank is transferred to said receiving opening;

a pair of retention bars fixed to said base plate at points centrally aligned across said receiving opening, said retention bars partially overlying said opening for engagement with the partition fold of a transferred blank to assist in positioning of the blank over the chamber opening, said retention bars including means for retaining a transferred blank over said opening and against upward movement therefrom upon retraction of the transfer means and positioning means in the path of a transferred blank for engaging said blank and deflecting selected portions thereof to encourage proper folding thereof within the forming chamber, wherein each retention bar including a vertical forward edge inwardly directed toward a transferred blank for engagement of the partition fold of the blank thereagainst, said means for retaining a blank against upward movement comprising overhanging shoulder-defining means along said forward edge for receiving the partition fold therebeneath.

18. In the apparatus of claim 17, said positioning means comprising a pair of projections on each retention bar extending laterally to the opposite sides of the forward edge thereof below the shoulder-defining means.

19. In apparatus for forming paperboard blanks into containers with depressed central compartments and peripheral flanges, said blanks having peripheral wall-defining panels, said apparatus including feeder means for receiving a stack of blanks and sequentially presenting the blanks in said stack forwardmost for removal therefrom, a forming chamber with an upwardly directed receiving opening, transfer means for individually transferring the forwardmost blank from said feeder means and positioning said blank over said receiving opening, glue applicator means, and vertically reciprocating container forming means for engaging a positioned blank and moving said positioned blank into said chamber with the intermediate panels folding upward to define walls, a base plate overlying said forming chamber, said receiving opening of the chamber being defined through said base plate, said transfer means including folding means for defining a partition fold in a transferred blank centrally thereacross as the blank is transferred to said receiving opening, and a pair of retention bars fixed to said base plate at points centrally aligned across said receiving opening, said retention bars partially overlying said opening for engagement with the partition fold of a transferred blank to assist in positioning of the blank over the chamber opening, each retention bar including a vertical forward edge inwardly directed toward a transferred blank for engagement of the partition fold of the blank thereagainst, means for retaining a blank against upward movement comprising overhanging shoulder-defining means along said forward edge for receiving the partition fold therebeneath, and positioning means comprising a pair of projections on each retention bar extending laterally to the opposite sides of the forward edge thereof below the shoulder-defining means.

* * * * *